United States Patent [19]

Reed

[11] Patent Number: 4,568,895

[45] Date of Patent: Feb. 4, 1986

[54] CAPACITOR ARRANGEMENTS, ESPECIALLY FOR AN ELECTRONICALLY TUNABLE BAND PASS FILTER

[75] Inventor: Robert E. Reed, Fort Wayne, Ind.

[73] Assignee: International Telephone and Telegraph Corporation, N.Y.

[21] Appl. No.: 467,544

[22] Filed: Feb. 17, 1983

[51] Int. Cl.[4] ..... H01P 1/205; H01P 7/06

[52] U.S. Cl. ..... 333/203; 333/209; 333/231; 361/291

[58] Field of Search ..... 333/202–212, 333/219–235, 24 C, 174; 334/41–45; 361/287, 290–295

[56] References Cited

U.S. PATENT DOCUMENTS

| | | | |
|---|---|---|---|
| 2,150,973 | 3/1939 | Houck | 361/291 |
| 2,179,068 | 11/1939 | Sprague | 361/291 |
| 2,500,875 | 3/1950 | Schüpbach | 333/224 |
| 3,286,195 | 11/1966 | Bachnick et al. | 334/45 |
| 4,037,182 | 7/1977 | Burnett et al. | 333/209 X |
| 4,380,747 | 4/1983 | Curtinot et al. | 333/209 X |

FOREIGN PATENT DOCUMENTS

| | | | |
|---|---|---|---|
| 363140 | 2/1973 | U.S.S.R. | 333/203 |

OTHER PUBLICATIONS

Weaver—"Transistors in UHF-TV Tuners", Texas Instruments Incorporated, presented at the Spring IRE Conference on Broadcast and Television Receivers, Chicago, Illinois, Jun. 1962; 15 pages.

*Primary Examiner*—Marvin L. Nussbaum

*Attorney, Agent, or Firm*—John T. O'Halloran; Peter R. Ruzek

[57] ABSTRACT

A capacitor arrangement which is especially suited for use in an electronically tunable narrow band tuned cavity filter includes two capacitor plate portions which are juxtaposed one another to form a capacitor. One of the capacitor plate portions may be provided with a recess and with an internally threaded bore which opens into the recess, and an externally threaded trimmer slug may be received in the bore and extend to a greater or lesser degree into the recess and thus to contribute to a greater or lesser degree to the total capacitance of the capacitor. A dielectric spacer may be interposed between the capacitor plate portions to determine the size of the gap therebetween and to maintain the gap size constant. One of the capacitor plate portions may be mounted on a support for movement toward and away from the other capacitor plate portion and be urged toward the latter in a yieldable manner so as to avoid undue stressing of the dielectric spacer resulting either from vibrations or from thermal expansion. When the capacitor arrangement is to be used in a tuned cavity filter including a plurality of resonator bars which are mounted in a cantilevered fashion, a portion of the respective resonator bar may be used as one of the capacitor plate portions, and a set of the capacitor arrangements of this construction may be arranged around the respective resonator bar so as to suppress oscillations of the latter in all transverse directions.

19 Claims, 8 Drawing Figures

CAPACITOR ARRANGEMENTS, ESPECIALLY FOR AN ELECTRONICALLY TUNABLE BAND PASS FILTER

BACKGROUND OF THE INVENTION

The Government has rights in this invention pursuant to Contract No. 30602-81-C-0117 awarded by the Department of the Air Force.

The present invention relates to capacitor arrangements in general, and more particularly to capacitor arrangements especially suited for use in a narrow band pass filter which is electronically tunable over a predetermined frequency range.

There are already known various capacitor constructions which are suited for use in filters capable of passing a relatively narrow band of frequencies. Such filters have a high degree of selectivity, which is important for establishing communications with a minimum of interference. This is of special significance in the field of military communications, such as between aircraft or between aircraft and ground, where a plurality of colocated transmitters and receivers operating within the same frequency range such as between 225 and 400 MHz may be operating simultaneously.

The desirability of use of such narrow band pass filters with a high degree of selectivity has already been recognized, and various filters of this type have been developed. So, for instance, there are known tuned cavity filters of the Butterworth and Chebyshev types which have relatively narrow pass bands, such as on the order of 2 percent of the transmission frequency, and relatively low insertion losses such as, for instance, around 1 dB at and around the tuned frequency. This, of course, requires precise adjustment of the capacitance included in the respective resonating circuit. Such filters achieve excellent results so long as they are being operated around the tuned frequency. However, tuning of such filters to a given frequency is relatively time-consuming, so that conventional tuned cavity filters of this type are not suited for use in communication links utilizing frequency-hopping techniques even at relatively low frequency-hopping rates.

To make filters of this type usable in arrangements utilizing frequency hopping, it was previously attempted to electronically tune the filter at any given instant of time to the respective narrow frequency band which includes the transmission frequency band. To this end, it was proposed to use a tuned cavity filter with tapped resonators, wherein a set of tuning capacitors was arranged in the tuned cavity at a tapping region of the respective resonator bar, each of the capacitors including a pair of spaced capacitor plates, one being electrically connected to the resonator at the tapping region and the other being switchable by an electronic switching circuit between its active and inactive states. Selective switching of the individual other capacitor plates of the set causes the respective capacitors to contribute or not to contribute to the total capacitance of the respective set and thus to the resonance frequency of the tuning capacitor-resonator bar circuit. The filter of this construction was of the combline type and was designed for use in low power receiver front ends.

Experience with tuned-cavity combline filters of this type using the electronically switchable capacitors arranged within the tuned cavity around the tapping regions of the resonator bars has shown that they have excessive insertion losses and other disadvantageous properties which make this filter hardly usable in high-power transmissions, if at all. The problems encountered in this particular filter construction are at least partially attributable to the accommodation of the pairs of capacitors contributing to the tuning capacitance, and the associated electric circuitry, in the tuned cavity where they are influenced by the electromagnetic field permeating the tuned cavity.

SUMMARY OF THE INVENTION

Accordingly, it is a general object of the present invention to avoid the disadvantages of the prior art.

More particularly, it is an object of the present invention to provide a capacitor arrangement which is especially suited for use in an electronically tunable narrow band pass filter and which does not possess the disadvantages of the known capacitor arrangements of this type.

Still another object of the present inventon is to construct the capacitor arrangement of the type here under consideration in such a manner as to permit very rapid, very precise, and very frequent tuning to relatively narrow bands including the respective frequencies of transmission.

It is yet another object of the present invention to develop a capacitor arrangement which can be used in a transmission system using frequency-hopping techniques at moderate to high hopping rates.

A further object of this invention is to devise a capacitor arrangement which can be tuned without changing the distance between the capacitor plate portions thereof.

An additional object of the invention is to provide a capacitor arrangement in which the capacitance is independent of external influences.

A concomitant object of the present invention is so to design a capacitor arrangement of the above type as to be relatively simple in construction, relatively inexpensive to manufacture, easy to use and reliable in operation nevertheless.

In pursuance of these objects and others which will become apparent hereafter, one feature of the present invention resides in a band pass filter including a housing bounding a tuned cavity, a plurality of resonator bars each extending across the tuned cavity, and a set of separate capacitor plates arranged around each of the resonator bars, each of the capacitor plates facing an associated region of the respective resonator bar to form a tuning capacitor therewith.

A particular advantage of this construction is that, since the respective resonator bar forms one of the capacitor plates of each of the tuning capacitors of the respective set, there is obtained an improved incorporation of the tuning capacitors into the resonating circuit containing the respective resonator as another member thereof, and the risk of failure due to loose or broken electrical connections is thus reduced.

Advantageously, the respective sets of capacitor plates are accommodated, together with respective extensions of the resonator bars which extend through associated openings of the housing and with associated switching circuitry which constitutes means for selectively activating and inactivating the tuning capacitors, in separate compartments of the housing which surround the aforementioned openings. The activating and inactivating means and the tuning capacitors are thus located outside the tuned cavity so that there is no interference of the electromagnetic field existing in the tuned cavity with the operation of the tuning capacitors. An additional capacitor plate may be mounted on a cover wall of the housing that spans the respective compartment, for movement toward and away from a capacitor plate portion of the extension of the respective resonator to form an initial tuning capacitor therewith, by means of which the respective resonating circuit can be tuned to an initial resonating frequency which is then influenced by the aforementioned tuning capacitors of the respective sets.

The capacitances of the individual tuning capacitors are so selected that the tuned bands of the filter partially overlap one another and that the insertion loss is within an acceptable range of, for instance, 2 dB even at the point of intersection of the neighboring tuned frequency bands. To this end the tuning capactors of the respective sets have different capacitances to provide a plurality of capacitive steps of different magnitudes. Advantageously, the capacitative steps are related to one another in a geometric progression, each succeeding capacitative step advantageously being twice the respectively preceding capacitative step. It was established that, to cover the range of frequencies between 225 and 400 MHz with insertion loss within the aforementioned limit, it is advantageous to use six capacitative steps related to one another in the above-mentioned fashion.

According to an advantageous concept of the present invention, which is useful in the context of the above-discussed filter but has general applicability in the field of construction of air-gap parallel-plate capacitors in general, there is provided an arrangement for varying the capacitance of the capacitor which has two associated capacitor plate portions defining a gap, this arrangement comprising means for bounding a recess in a region of one of the plate portions which is juxtaposed with the other plate portion, and at least one part that is at least partially received in the recess and is operative for contributing to the total capacitance of the capacitor. The aforementioned part is advantageously constructed as an externally theaded trimmer slug that is received in an internally threaded bore of the one plate portion which opens into the recess. Thus, turning of the slug in the bore will cause the slug to project to a greater or lesser extent into the recess, and thus contribute to a greater or lesser degree to the total capacitance of the capacitor.

The present invention also relates to a capacitor arrangement which may be used for damping mechanical oscillations of the respective resonator bar and/or for compensating for thermal expansion of the various components of the filter and particularly of the capcitor arrangement used therein. However, here again, the concept utilized herein has a much broader utility. According to this concept, the capacitor arrangement includes two capacitor plate portions one of which is rigid with a support, while mounting means is provided which mounts the other of the capacitor plate portions on the support for movement in and opposite to a predetermined direction toward and away from the one capacitor plate portion in such an orientation relative to the latter as to define a gap of a varying size therewith. Then there is provided means for determining the size of the gap and maintaining the same constant as external conditions are applied to the capacitor arrangement, such determining and maintaining means including dielectric spacer means interposed between the capacitor plate portions and having a dimension in the predetermined direction which corresponds to the desired size of the gap, and means for urging the other capacitor plate portion with a predetermined force in the predetermined direction with attendant determination of the size of the gap by the spacer means. Advantageously, the mounting means includes a support plate which is stationary relative to the support and has a recess, and a spacer plate on which the capacitor plate portion is supported and which is partially received in the recess of the support plate for movement therein toward and away from the on capacitor plate. The urging means preferably includes spring means which is received in the recess and acts on the spacer plate to urge the same and thus the other capacitor plate toward the one capacitor plate.

Above-mentioned and other features and objects of the invention will become more apparent by reference to the following description taken in conjunction with the accompanying drawing in which:

DETAILED DESCRIPTION OF THE PREFERRED EMBODIMENTS

Figure 1:
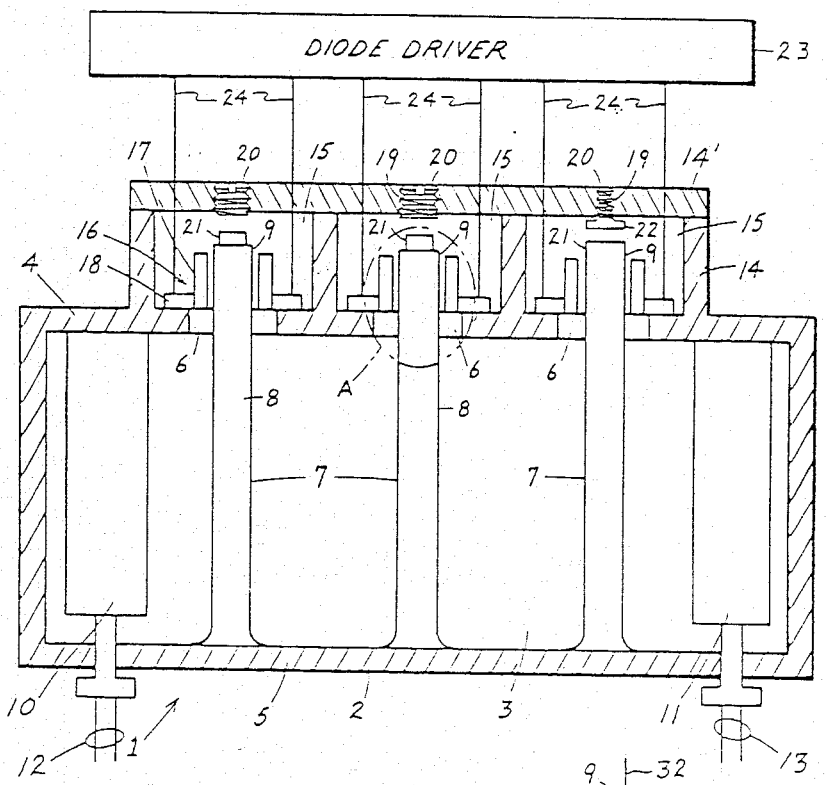
FIG. 1 is a partly diagrammatic sectional view of a filter constructed in accordance with the present invention.

Referring now to the drawing in detail, and first FIG. 1 thereof, it may be seen that the reference numeral 1 has been used to identify a combline-type filter, in which the capacitor arrangement of the present invention is currently being used, in its entirety. The filter 1 includes a housing 2 that bounds a tuned cavity 3. The housing 2 includes, as considered in the position illustrated in FIG. 1, a top wall 4 and a bottom wall 5. The top wall 4 has a plurality of through openings 6 therein. The filter 1 further includes a plurality of resonator bars 7 each of which is secured to the bottom wall 5 of the housing 2 and extends therefrom toward one of the openings 6. Each of the resonator bars 7 has a resonator section 8 which extends across the tuned cavity 3, and an extension 9 which extends to the exterior of the tuned cavity 3 through the respective opening 6.

The tuned cavity 3 further receives an input transformer 10 and an output transformer 11. Electric leads 12 are connected to the input transformer 10 and are operative for energizing the latter in dependence on the electric signal to be filtered. The output transformer 11 has electric leads 13 connected thereto, the leads 13 carrying electric signals representative of the filtered information as obtained from the filter 1. The construction and operation of a tuned-cavity combline-type filter 1 as described so far but without the extensions 9 is so well known from its use as a narrow-band fixed-tuned filter that no elaboration thereon is needed here. Suffice it to say that the filter 1 used in the present invention preferably is constructed as a three-pole Butterworth filter with the resonator bars 7 arranged in a combline array.

The extensions 9 are arranged at the high-impedance ends of the respective resonator sections 8. As illustated in FIG. 1, the housing 2 is provided with a superstructure 14 bounding a plurality of compartments 15. The compartments 15 are arranged around the respective openings 6, and the extensions 9 of the respective resonator bars 7 project into the respective compartments 15. Each of the compartments 15 also accommodates a set of tuning capacitor arrangements 16 distributed around the respective extension 9 in a manner which will be discussed in detail later on. Each of the arrangements 16 includes a tuning capacitor plate 17 and a switching network 18 which is shown only in block form in FIG. 1.

As shown in FIG. 1, the compartments 15 have upwardly facing open ends. These open ends are closed by a cover wall 14' which is shown to be separate from the superstructure 14. For obvious reasons, the cover wall 14' will be secured to the superstructure 14 by any conventional means, such as by screws.

The cover wall 14' is provided with a plurality of internally threaded bores 19 which are respectively aligned with the extensions 9 in the mounted position of the cover wall 14' on the superstructure 14. Each of the threaded bores 19 accommodates an externally threaded plug 20 which is so constructed as to be able to serve as an additional capacitor plate. In this respect, the plug 20 cooperates with a capacitor plate portion 21 of the extension 9. The capacitor plate portion 21 has been illustrated in FIG. 1 as being of a different configuration than the rest of the extension 9, for instance, cylindrical in conformity with the cylindrical configuration of the plug 20. However, the capacitor plate portion 21 may also have the same cross-section as the remainder of the extension 9 and thus be visually indistinguishable therefrom. The plug 20 may have such a diameter as to itself serve as a capacitor plate; however, it could also have a relatively small diameter and be connected to a capacitor plate 22 proper, as illustrated in the right-hand portion of FIG. 1 which also indicates the indistinguishable configuration of the capacitor plate portion 21 of the extension 9 of the resonator bar 7. The capacitor plate portion 21 and either the capacitor plate 22 or the plug 20 configurated to form the capacitor plate together form an initial tuning capacitor. By turning the plug 20 in the threaded bore 19 of the cover wall 14', it is possible to initially tune the resonator circuit including the resonator bar 7 inclusive of its extension 9 and the initial tuning capacitor to a desired resonant frequency such as, for instance, 400 MHz.

Figure 2:
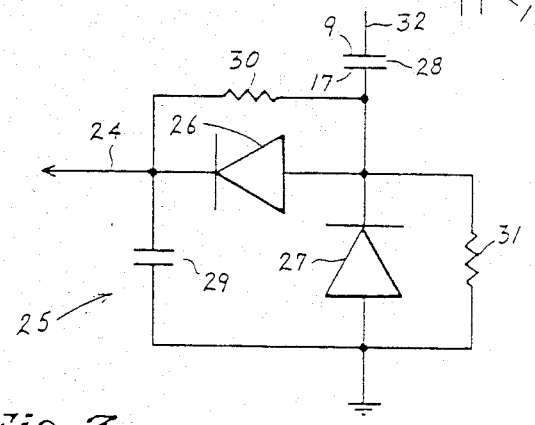
FIG. 2 is a diagrammatic representation of a single capacitor switching circuit for use in the filter according to FIG. 1.

Finally, FIG. 1 also illustrates, in a diagrammatic fashion, a diode drive 23 which is connected by individual leads 24 with the respective tuning capacitor arrangements 16. One lead 24 is provided for each of the arrangements 16. The diode drive receives information as to the instantaneous frequency to which the filter 1 is to be tuned and translates this information, in a known manner which need not be discussed here, into driving signals which are then applied to the respective leads 24 and through the same to the respective tuning capacitor arrangements 16. As illustrated in FIG. 2, the respective lead 24 is connected to an electric switching circuit 25 which includes, as its main components, a switching diode 26, a grounded shunting diode 27, and a tuning capacitor 28. The switching circuitry or network 25 further includes a capacitor 29 interposed between the line 24 and the ground, and two resistors 30 and 31 respectively arranged in series with the switching diode 26 and with the shunting diode 27.

To correlate the electric circuit of FIG. 2 to the filter 1 depicted in FIG. 1, it is to be realized that the capacitor plates of the tuning capacitor 28 of FIG. 2 respectively correspond to the capacitor plate 17 and to a portion of the extension 9 of the respective resonator bar 7 of FIG. 1, while the remainder of the electric circuitry 25 interposed between the lead 24, the ground, and the capacitor plate 17 constitutes a part of the circuitry of the switching network 18 diagrammatically indicated in FIG. 1. A lead 32 from the capacitor region of the extension 9 of the tuning capacitor 28 represents the electrical connection to the section 8 of the resonator bar 7 as shown in FIG. 1.

The switching diode 26 and the shunting diode 27 are preferably so-called PIN or NIP diodes with an intrinsic region interposed between the p and n regions. Such diodes exhibit low forward drop at high currents. The diodes 26 and 27 shown in FIG. 2 are NIP diodes. Trigger signals supplied from the diode drive 23 through the respective line 24 to the switching diode 26 will turn the latter on, thereby including the tuning capacitor 28 in the electric circuit with the extension 9 and the resonator section 8 with attendant lowering of the resonating frequency of the resonating circuit including the resonator bar 7. In the absence of such signals, the switching diode 26 is turned off and the tuning capacitor 28 is excluded from the electric circuit with the resonator 7. By selectively activating and deactivating the respective tuning capacitors 28 of the respective set, that is, by selectively turning the switching diodes 26 associated therewith on and off, it is possible to tune the resonating frequency of the resonating circuit of the respective resonator bar 7 to any desired narrow frequency band within the frequency range.

Figure 3:
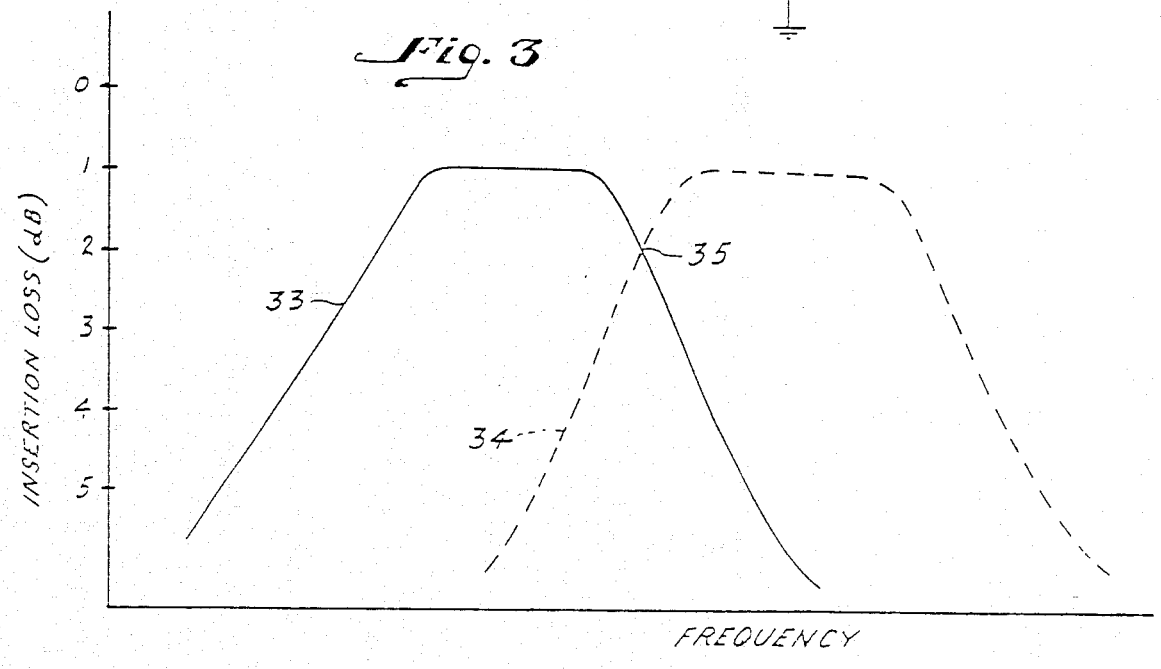
FIG. 3 is a graphic representation of the relationships between insertion loss and frequency for the filter according to FIG. 1.

In accordance with a currently preferred aspect of the present invention, the tuning capacitors 28 of the respective set all have different capacitances so as to provide a plurality of capacitance steps. Obviously, the size of the smallest capacitance step will determine the minimum spacing between the adjacent bands. The characteristic response of the filter 1 constructed in accordance with FIG. 1 to various frequencies in terms of insertion loss is depicted in FIG. 3 for two of such adjacent bands. A curve 33 is representative of the response of the filter to one combination of tuning capacitances supplied by the tuning capacitors 28 of the respective set, while a curve 34 is representative of the response for an adjacent band for a combination of tuning capacitances differing from the combination of the curve 33 by the smallest capacitive step. The curves 33 and 34 intersect at a cross-over point 35. It may be seen that the curves 33 and 34 have relatively steep slopes at the upper and lower regions of the respective frequency bands, and a substantially flat plateau in the central region of the band. The insertion loss at the center frequency of the band is in the vicinity of 1 dB, while the insertion loss at the cross-over point 35 is about 2 dB, which satisfies the design criteria. The width of the band is about 2 percent of the central frequency at the 3 dB level. It will be appreciated that the shapes of the curves 33, 34 and those of the remaining bands throughout the frequency range to be covered, such as between 225 and 400 MHz, in conjunction with the maximum acceptable insetion loss at the cross-over point 35, will determine the number and size of the capacitive steps of the tuning capacitors 28 of the respective set. It was established that, to obtain the situation depicted in FIG. 3, it is advantageous to use six of the tuning capacitors 28 in each of the sets. The capacitances of these tuning capacitors 28 are advantageously related to one another in a geometric progression, the size of any succeeding capacitive step being advantageously twice that of the immediately preceding step. In this manner, there is obtained a binary-type progression which is easy to implement and use.

Figure 4:
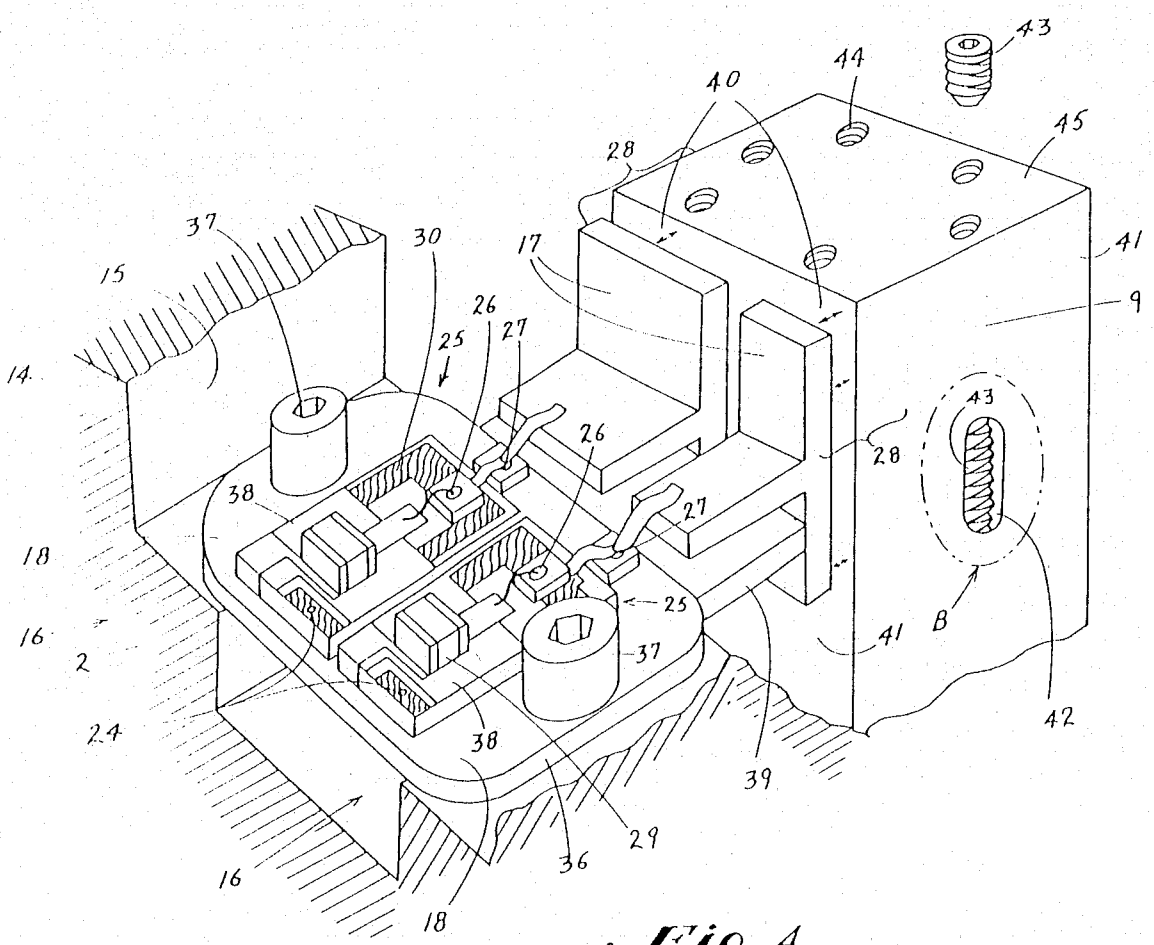
FIG. 4 is an enlarged perspective view of a detail A of FIG. 1.

Turning now to FIG. 4 of the drawing, it may be seen that it shows two of the tuning capacitor arrangements 16 arranged at one circumferential face of the extension 9 of the resonator bar 7. The switching networks 18 of these arrangements 16 are mounted on a common metallic support plate 36 which, in turn, is mounted on the top wall of the housing 2 within the compartment 14 of the superstructure 15 by means of respective mounting bolts 37. The metallic support plate 36 simultaneously serves as a heat sink and as an electric ground. The switching networks 25 are constructed by using printed circuit technology. As shown, the bypass capacitor 29, the switching diode 26 and the resistor 30 are all arranged on a substrate 28 which is connected to or integral with the support plate 36. On the other hand, the shunting diode 27 is directly mounted on the support plate 36.

A dielectric spacer and support plate 39 is secured to the support plate 36 and extends therefrom toward the extension 9 of the resonator bar 7. Two capacitor plates 17, each associated with one of the switching networks 25, are mounted adjacent to one another on the dielectric spacer and support plate 39. The capacitor plates 17 define respective air gaps 40 with an associated planar peripheral face 41 of the extension 9 of the resonator bar 7. In this manner, the capacitor plates 17 and the extension 9 together form the respective tuning capacitors 28. The extension 9 is shown to have a rectangular or square cross-section, thus presenting four of the peripheral faces 41 for juxtaposition of the capacitor plates 17 therewith. Since, as mentioned previously, each set of the tuning capacitor arrangements 16 includes six of such arrangements, it will be apparent that two of the arrangements 16 will have to be associated with each of two of the peripheral faces 41. The remaining two arrangements 16 can then be arranged one at each of the remaining peripheral faces 41 of the extension 9.

Figure 5:
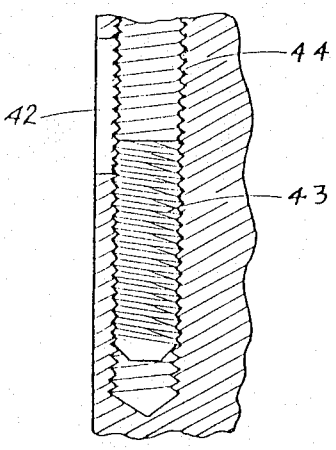
FIG. 5 is a sectional view of detail B of FIG. 4.

FIG. 4, and in even greater detail FIG. 5, illustrates another expedient used in accordance with the present invention. This expedient is based on the recognition of the fact that it is needed to fine-tune the capacitances of the respective capacitors 28. Coarse adjustment of the capacitances is achieved by properly adjusting the sizes of the respective air gaps 40. To achieve the fine capacitance tuning, the extension 9 is provided, at a region thereof which is juxtaposed with the respective capacitor plate 17, with a recess or window 42. A trimmer slug 43 partially extends into the recess 42, thus contributing to the total capacitance of the respective tuning capacitor 28. The extent to which the trimmer slug 43 extends into the recess 42 determines the amount of contribution of the trimmer slug 43 to the total capacitance of the respective capacitor 28. To be able to vary the amount by which the trimmer slug 43 contributes to the total capacitance, the trimmer slug 43 is externally threaded and is received in an internally threaded bore 44 which opens onto a top end face 45 of the extension 9 at one of its ends and passes through and slightly beyond the recess 42 at its other end. Thus, turning the trimmer slug 43 about its axis will result in upward or downward movement of the trimmer slug 43 in the bore 44, whereby the extent to which the trimmer slug 43 extends into the recess 42 and thus its contribution to the total capacitance are varied.

Figure 7:
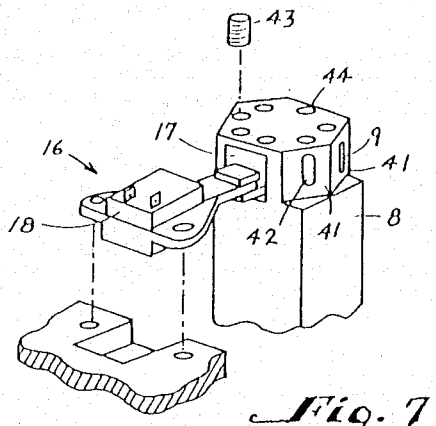
FIG. 7 is a perspective view of the detail A of FIG. 1 but showing the modified construction of FIG. 6.

Experience with the construction as illustrated in FIG. 4 has shown that the adjacently mounted capacitors 17 may influence one another due to stray capacitances. This problem is avoided in the construction shown in FIG. 6, where the extension 9 has a hexagonal cross-section, thus presenting six of the peripheral surfaces 41 for the juxtaposition of the six capacitor plates 17 of the set with such peripheral surfaces 41. As shown in FIG. 7, the resonating section 8 preferably has rectangular or square cross section, and it is only the extension 9 which has the hexagonal cross section. To achieve this result, the extension 9 is provided with additional facets at the corners of the rectangular or square contour of the resonating section 8 to form the respective peripheral faces 41. Of course, the extension 9 need not have the cross section of a regular hexagon; rather, the angles at which the aforementioned facets are inclined may be so selected as to obtain different areas for the respective peripheral faces 41, correspondingly to the areas needed for the formation of the respective tuning capacitors 28.

Figure 6:
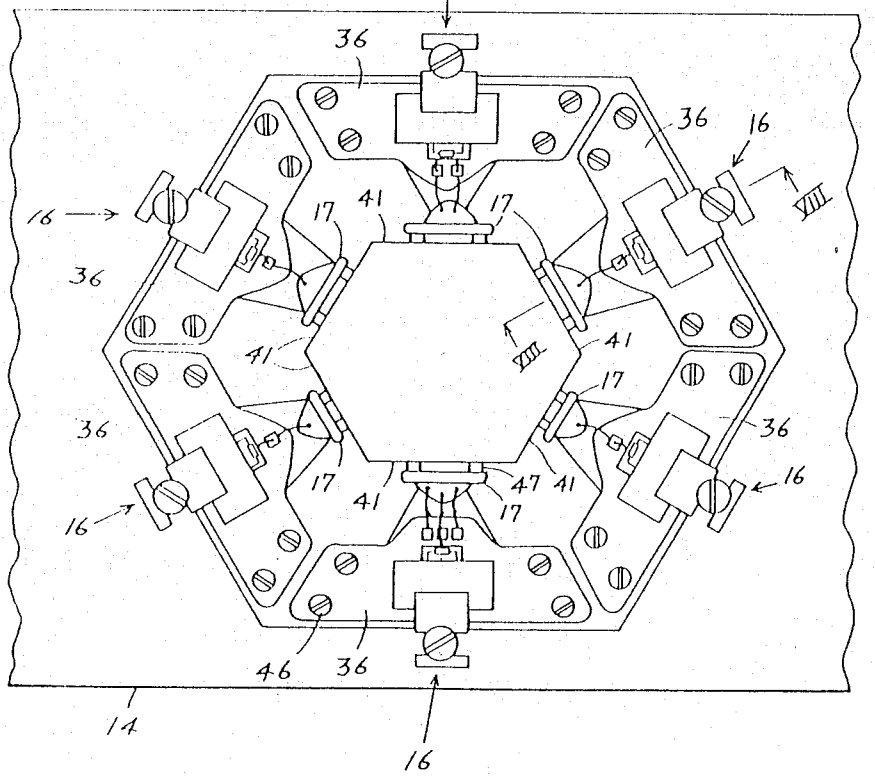
FIG. 6 is an enlarged top plan view of the area of the detail A of FIG. 1 showing a modified construction.

The plates 36 are shown in FIG. 6 to be mounted by means of mounting bolts 46 rather than by the mounting bolts 37 shown in FIG. 4. Spacers 47 of dielectric material may be interposed between the capacitor plates 17 and the surfaces 41 of the extension 9. These spacers 47 serve for holding the extension 9 in position relative to the capacitor plates 17. Referring now back to FIG. 1, it may be seen that the resonator bars 7 are secured only to the bottom wall 5 of the housing 2, so that they constitute cantilevers. Now, should the filter 1 be subjected to mechanical vibration, as is often the case in airplanes or at other intended locations of use of the filter 1, the cantilevered resonator bars 7 could vibrate or oscillate in response to such mechanical vibrations, especially if the frequency of the latter were in the vicinity of the natural resonance frequency of the resonator bars 7 or multiples thereof, whereby the sizes of the air gaps 40 would change with attendant changes in the tuned frequencies of the tuning capacitors 28. This situation is avoided or at least significantly improved by the use of the spacers 47.

In order to keep the resonator bar 7 from vibrating, the spacers 47 have to be relatively rigid. However, most highly rigid dielectric materials are also very brittle. To avoid the possibility of crushing the spacers 47 by the forces with which the capacitor plates 17 and the extension 9 act thereon, while still at least damping or suppressing the vibrations of the resonator bars 7 and maintaining the sizes of the air gaps 40 of the tuning capacitors 28 constant, it is proposed to so mount the capacitor plates 17 on the housing 2 as to be able to move relative to the housing 2 and thus to eliminate undue stressing of the spacers 47. This possibility is illustrated in FIG. 8.

Figure 8:
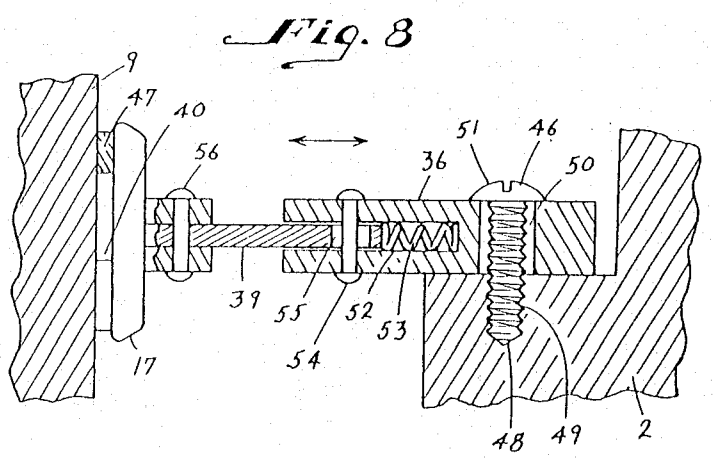
FIG. 8 is a cross-sectional view taken on line VIII—VIII of FIG. 6 but showing a further modification.

As shown in FIG. 8, the housing 2 is provided with an internally threaded bore 48 which meshingly receives an externally threaded shank portion 49 of the respective bolt 46. The shank portion 49 passes through an opening or slot 50 of the support plate 36, the opening 50 being larger at least in the directions indicated by the double-headed arrow than the corresponding section of the shank portion 49, so that the support plate 36 can move in the directions of the double-headed arrow so long as the bolt 46 is loose and is clamped in position by a head portion 51 of the bolt 46 upon tightening. When the bolt 46 is tightened, the support plate 36 is stationary relative to the housing 2.

The support plate 36 is shown to have a recess 52 which accommodates a portion of the dielectric spacer and support plate 39 for movement therein in the direction of the double-headed arrow. At least one spring 53 is accommodated in the recess 52 and rests against the bottom of the latter and acts on the spacer and support plate 39 to urge the same toward the extension 9. The extent of movement of the spacer and support plate 39 relative to the support plate 36 is limited by a travel limiting rivet 54 or a similar element which passes through an opening or slot 55 of the spacer and support plate 39. The opening 55 again has a dimension exceeding the corresponding dimension of the rivet 54 at least in the directions indicated by the double-headed arrow. Thus, the spacer and support plate 39 is free to perform movement within a range limited by the rivet 54 and the slot 55 relative to the stationary support plate 36 in the directions of the double-headed arrow, with attendant compression or relaxation of the spring or springs 53. The pre-tension of the spring or springs 53 is adjusted by selecting the desired position of the support plate 36 with the bolt or bolts 46 loosened, and is then maintained by tightening the bolt or bolts 46 and thus clamping the support plate 36 in position. It is also shown in FIG. 8 that the capacitor plate 17 is mounted on the spacer and support plate 39 by a rivet 56 or a similar fastening element. Thus, the force exerted by the respective spring 53 on the spacer and support plate 39 will be transmitted through the rivet 56 and the capacitor plate 17 to the spacer 47 and ultimately to the extension 9, so that mechanical oscillations or vibrations of the latter relative to the housing 2 will be damped by the action of the spring or springs 53. Yet, the resiliency imparted to the mounting arrangement by the presence of the spring or springs 53 will prevent undue stressing of the material of the spacer 47 which could lead to destruction of the latter and which could result either from the mechanical vibrations or from thermal expansion of the extension 9 and/or of the mounting arrangement.

The present invention has been described above as employed in a narrow band filter utilizing an extended resonator concept. However, the expedients and features described above, especially the use of the resonator bar as one of the tuning capacitor plates, could also be used in the above-discussed tapped resonator construction. Moreover, the above-discussed concept of using the trimmer slug projecting into the recess of one of the capacitor plate portions for varying the capacitance of the capacitor could be used in differently constructed capacitors and in capacitors used in different arrangements. Similarly, the concept of movably mounting one of the capacitor plate portions relative to the other capacitor plate portion, and the use of the dielectric spacer means in conjunction with the urging means could be employed in capacitors intended for uses in environments differing from the above-described one, so long as there is a need for compensating for thermal expansion or for damping oscillations while maintaining the size of the capacitor gap constant.

While I have described above the principles of my invention in connection with specific apparatus, it is to be clearly understood that this description is made only by way of example and not as a limitation to the scope of my invention as set forth in the objects thereof and in the accompanying claims.

I claim:

1. A band pass filter comprising
a housing bounding a tuned cavity;
a plurality of resonator bars each extending across said tuned cavity; and
a set of mechanically and electrically separate capacitor plates arranged around each of said resonator bars, each of said capacitor plates facing an associated region of the respective resonator bar to form a tuning capacitor therewith.

2. The filter as defined in claim 1, wherein the capacitances of said tuning capacitors differ from one another.

3. The filter as defined in claim 1, wherein said resonator bars are secured to said other wall and form cantilevers; and further comprising means for at least suppressing mechanical oscillations of said resonator bars relative to said capacitor plates with attendant capacitance variations of said tuning capacitors.

4. The filter as defined in claim 3, wherein said suppressing means includes spacer means interposed between said capacitor plates and said resonator bar.

5. A band pass filter for use with an electronic drive operative for issuing control signals, comprising
a housing bounding a tuned cavity;
a plurality of resonator bars each extending across said tuned cavity;
a set of separate capacitor plates arranged around each of said resonator bars, each of said capacitor plates facing an associated region of the respective resonator bar to form a tuning capacitor therewith; and
means for selectively activating and deactivating said capacitor plates in dependence on said signals to thereby include the respective tuning capacitors of the respective sets in, and exclude the same from, electric circuit with the respective resonators, and thus to vary the tuned frequency band of the filter.

6. A band pass filter, comprising
a housing having opposite walls one of which has a plurality of openings, said housing bounding a tuned cavity and a plurality of compartments situated externally of said tuned cavity around the respective through openings;
a plurality of resonator bars extending from the other of said opposite walls across said tuned cavity toward said openings and having respective extensions extending through said openings into said compartments; and
a set of separate capacitor plates, said capacitor plates of the respective set being accommodated in the respective one of said compartments around each of said resonator bars, each of said capacitor plates of the respective set facing an associated region of the respective resonator bar to form a tuning capacitor therewith.

7. The filter as defined in claim 3, wherein said housing further includes at least one cover wall extending across the respective compartment transversely of and with an axial spacing from said extension of the respective resonator; wherein said extension has a capacitor plate portion facing said cover wall; and further comprising an additional capacitor plate juxtaposed with said capacitor plate portion and forming an intial tuning capacitor therewith that is permanently included in electric circuit with the respective resonator.

8. The filter as defined in claim 7, wherein said additional capacitor plate is mounted on said cover wall for movement toward and away from said capacitor plate portion to thereby vary the capacitance of said initial tuning capacitor.

9. The filter as defined in claim 8, wherein said cover wall has a threaded bore therein that is aligned with said capacitor plate portion; and wherein said additional capacitor plate includes a threaded plug meshingly received in said threaded bore.

10. A band pass filter comprising a housing bounding a tuned cavity;

a plurality of resonator bars each extending across said tuned cavity;

a set of separate capacitor plates arranged around each of said resonator bars, each of said capacitor plates facing an associated region of the respective resonator bar to form a tuning capacitor therewith; and means for adjusting the capacitance of the respective tuning capacitor, including an adjusting section of one of said capacitor plate and said associated region of said resonator bar having a recess therein, and at least one part at least partially received in said recess and operative for contributing to the total capacitance of said tuning capacitor.

11. The filter as defined in claim 10, wherein said recess is provided in said associated region.

12. The filter as defined in claim 10, wherein said adjusting section further has a bore that opens into said recess; and wherein said part is a slug received in said bore for movement therein between different positions in which it extends to a greater or lesser degree into said recess to contribute more or less to the tuning capacitance of said tuning capacitor.

13. The filter as defined in claim 12, wherein said bore has an internal thread; and wherein said slug is externally threaded to mesh with said internal thead and to conduct said movement between said different positions in response to the turning of said slug.

14. A band pass filter comprising a housing bounding a tuned cavity;

a plurality of resonator bars each extending across said tuned cavity and being cross-sectionally polygonal to present a plurality of flat zones; and a set of separate capacitor plates arranged around each of said resonator bars, each of said capacitor plates facing one of said flat zones of the respective resonator bar to form a tuning capacitor therewith.

15. The filter as defined in claim 11, wherein at least one of said capacitor plates is juxtaposed with each of said flat zones to form the respective tuning capacitor with said associated region.

16. A band pass filter comprising a housing bounding a tuned cavity;

a plurality of resonator bars each extending across said tuned cavity;

a set of separate capacitor plates arranged around each of said resonator bars, each of said capacitor plates facing an associated region of the respective resonator bar to form a tuning capacitor therewith, the capacitances of said tuning capacitors differing from one another and being in geometric progression relative to one another.

17. A band pass filter comprising a housing bounding a tuned cavity and having two opposite walls;

a plurality of resonator bars each secured to one of said opposite walls and extending across said tuned cavity to form cantilevers;

a set of separate capacitor plates arranged around each of said resonator bars, each of said capacitor plates facing an associated region of the respective resonator bar to form a tuning capacitor therewith;

means for mounting at least one of said capacitor plates on said housing for movement toward and away from the respective resonator bar; and means for at least suppressing mechanical oscillations of said resonator bars relative to said capacitor plates with attendant capacitance variations of said tuning capacitors, including spacer means interposed between said capacitor plates and said resonator bar and means for resiliently urging said one capacitor plate toward said resonator bar.

18. A capacitor arrangement mounted on a support, comprising:

two capacitor plate portions, one of which is rigid with the support;

means for mounting the other of said capacitor plate portions on the support for movement in and opposite to a predetermined direction toward and away from said one capacitor plate portion in such an orientation relative to the latter as to define a gap of varying size therewith, including:

a support plate stationarily mounted on the support and having a recess, and a spacer plate partially received in said recess for movement therein in and opposite to said predetermined direction, said other capacitor plate portion being mounted on said spacer plate; and means for determining the size of said gap and maintaining the same constant as external conditions are applied to the capacitor arrangement, including:

dielectric spacer means interposed between said capacitor plate portions and having a dimension in said predetermined direction corresponding to the desired size of said gap, and means for urging said other capacitor plate portion with a predetermined force in said predetermined direction with attendant determination of the size of said gap by said spacer means, including spring means received in said recess, interposed between the support and said other capacitor plate portion and acting on said spacer plate in said predetermined direction.

19. The capacitor arrangement as defined in claim 18, and further comprising means for limiting the extent of movement of said spacer plate relative to said support plate, including an elongated limiting element rigid with one of said plates and extending across and beyond said recess, and means for bounding in the other of said plates an opening having a dimension in said predetermined direction that exceeds the corresponding dimension of said limiting element.

* * * * *